United States Patent [19]

Frye, Jr.

[11] Patent Number: 4,522,142

[45] Date of Patent: Jun. 11, 1985

[54] RUDDER-TILLER CONTROL SYSTEM FOR A BOAT

[76] Inventor: John W. Frye, Jr., Rte. 2, Box 99, Aberdeen, N.C. 28315

[21] Appl. No.: 650,985

[22] Filed: Sep. 14, 1984

Related U.S. Application Data

[63] Continuation of Ser. No. 488,015, Apr. 25, 1983, abandoned.

[51] Int. Cl.[3] ..... B63H 25/06

[52] U.S. Cl. ..... 114/163; 74/480 B

[58] Field of Search ..... 114/144 R, 162, 163, 114/169, 165, 61, 123; 74/513, 470, 480 B

[56] References Cited

PUBLICATIONS

"Stock" part.
"Updated" Murray device.
"Original" Murray device.

*Primary Examiner*—Trygve M. Blix
*Assistant Examiner*—Stephen P. Avila
*Attorney, Agent, or Firm*—Cox & Smith Inc.

[57] ABSTRACT

The present invention entails a rudder-tiller control system for a boat. In one embodiment of the present invention, a multi-hull boat is shown with a plurality of rudders, a rudder-tiller arm extending from each rudder, and a tiller connector bar operatively interconnected to each rudder-tiller arm through a universal type connector assembly. The connector assembly operatively interconnected between respective rudder-tiller arms and the tiller connector bar allows at least three degrees of freedom and relative movement between respective rudder-tiller arms and the tiller connector bar. More specifically, each connector assembly includes a housing having a ball joint rotatively confined within a spherical shaped cavity within the housing. Secured to the ball joint and extending therefrom is a connecting pin. In a connected environment, the housing of the connector assembly is secured to the tiller connector bar while each rudder-tiller arm is securely connected to the connecting pin extending from the ball joint. Consequently, the rudder-tiller arm may rotate with respect to the tiller connector bar about the center point of the ball joint. The result is the connector assembly provides a generally rigid joint while at the same time providing relative rotational freedom between the rudder-tiller arm and the connector bar about the center point of the ball joint through 360 degrees of motion in a horizontal plane and approximately 300 degrees in both fore-and-aft and side-to-side vertical planes.

10 Claims, 6 Drawing Figures

RUDDER-TILLER CONTROL SYSTEM FOR A BOAT

This application is a continuation of application Ser. No. 488,015, filed on Apr. 25, 1983 now abandoned.

FIELD OF INVENTION

The present invention relates to boats and to rudder-tiller linkage arrangements, and more particularly to a connector assembly that interconnects a rudder-tiller arm to a tiller connector bar in a rudder-tiller control system for a boat.

BACKGROUND OF INVENTION

Multi-hull boats such as catamarans, typically employ a tiller-rudder linkage arrangement that includes a plurality of rudders with a rudder-tiller arm extending from each rudder, and a tiller connector bar operatively interconnected between respective rudder-tiller arms. The design of the rudder-tiller control linkage is such that the rudder and tiller connector bar can assume various positions. For example, the rudder may assume an up or down position, or any combination of an up or down position. Likewise, the tiller connector bar can be raised up or down or inclined with one end up and the other end down. Thus it is appreciated that the tiller-rudder linkage system can assume many positions and orientations depending on the particular position of the rudder and/or tiller connector bar.

To accomplish these various positions, it is appreciated that the connector interconnected between the respective rudder-tiller arms and said tiller connector bar must be capable of providing relative movement in three separate planes or about three separate axes. Typically, this has been achieved by providing a connector having a connecting pin with a primary axis to which the rudder-tiller arm is pivotably connected and providing a spring disposed between each rudder-tiller arm and said tiller connector bar. Relative rotation is achieved by the rotation of said rudder-tiller arm about the connecting pin. Relative movement or degrees of freedom in other planes is achieved by the spring and the "slop" design in the connector itself.

Besides not functioning smoothly and efficiently, spring type tiller connectors with built-in "slop" present several problems. First of all, the movement that is achieved through the spring and "slop" is very limited and is not sufficient in all circumstances to be considered effective. Further, with such designs, the tiller-connector assembly finds itself under substantial stress and tension at extreme angles of rudder deflection. Because of this stress, it is not uncommon for the bolt of such a connector to bend and even in some cases to break.

With a spring type connector having the built-in "slop", one finds that such a design results in the rudders continuing to drift back and forth and to "hunt". This gives rise to substantial rudder drag and greatly affects the sensitivity, response and "feel" of the rudder-tiller control system and offers increased resistance to boat motion through the water.

Therefore, there is a need for a relative firm and rigid rudder-tiller arm and tiller connector bar connector assembly that provides for relative movement, without "slop", between the rudder-tiller arm and said tiller connector bar in three planes or about three axes to accommodate the natural movement of the various linkages and components comprising the rudder-tiller control system of a boat.

SUMMARY AND OBJECTS OF PRESENT INVENTION

The present invention presents an improved rudder-tiller linkage and control system for a boat that overcomes the problems and disadvantages of conventional systems. In particular the rudder-tiller linkage and control system of the present invention provides a new universal type connector assembly for interconnecting respective rudder-tiller arms with the tiller connector bar wherein the connector assembly is generally rigid and without the "slop" normally associated with conventional connectors. Yet the connector assembly of the present invention provides relative movement about the connector in three planes or about three axes to accommodate the various positions and orientations that the rudder-tiller linkage and control system may assume.

Specifically, the connector assembly of the present invention includes a housing having a ball joint movably confined therein, and wherein there is provided a connecting pin that extends from said ball joint. In one embodiment, the connector bar is coupled to said rudder-tiller arm via the connector assembly. To accomplish this, the connecting pin is rigidly connected to the rudder-tiller arm while the housing of the connector assembly is secured to said connector bar. Because the ball joint is movable within the housing, this allows the rudder-tiller arm to effectively rotate about the center point of the ball joint. Further, the housing for the ball joint is itself adjustable laterally in and out of said connector bar or expressed in another way, the distance between the pivot points may be lengthened or shortened along the axis of the said tiller connector bar. It is, therefore, appreciated that this flexibility within the universal type connector assembly of the present invention enables the rudder-tiller linkage and control system to be moved, positioned and oriented in a variety of positions without placing significant stress and tension on the linkage system. In addition, the problems generally associated with rudder-tiller linkage systems of the past, as discussed above, are not present with the rudder-tiller linkage system of the present invention.

It is, therefore, an object of the present invention to provide a rudder-tiller linkage and control system for a boat having an improved connector assembly for interconnecting respective rudder-tiller arms of the system with a tiller connecting bar.

A further object of the present invention resides in the provision of a connector assembly for a rudder-tiller linkage and control system that is generally rigid and does not include the "slop" ordinarily associated with conventional connector assemblies for rudder-tiller linkage networks.

A further object of the present invention is to provide a rudder-tiller linkage arrangement for a boat that is designed with sufficient flexibility to allow relative movement between the respective rudder-tiller arms and the tiller connector bar in order that the boat may perform as intended and as required in all phases of normal operation.

Still a further object of the present invention is to provide a flexible rudder-tiller linkage arrangement as just described that is provided for by utilizing a universal ball joint type connector assembly interconnected between respective rudder-tiller arms and said tiller connector bar, wherein the universal ball joint type connector assemblies provide freedom of relative movement between said rudder-tiller arms and said tiller connector bar in at least three planes or about three separate axes.

Also an object of the present invention resides in the provision of a rudder-tiller linkage arrangement for a boat wherein the universal type connector assembly is of a ball joint type that is freely rotatable to provide relative movement in an infinite number of planes or about an infinite number of axes, thereby providing a generally rigid connector assembly that because of its design inherently results in a wide range of relative movement between the respective elements connected thereby.

A further object of the present invention resides in the provision of a rudder-tiller linkage arrangement and a connector assembly therefor as described, which eliminates the "slop" associated with compression spring type connectors of the prior art.

It is also an object of the present invention to provide a rudder-tiller linkage network as described hereinabove with respective connector assemblies that can easily withstand the tension and stress placed on the respective connecting joints of the linkage network and which will not fail.

It is also an object of the present invention to provide a rudder-tiller linkage network and connector assemblies therefor that is designed to provide generally firm and rigid connecting joints between the rudder-tiller arms and tiller connector bar in order that the rudders will not tend to independently drift or "hunt", sometimes referred to as uncontrollable "toe in" or "toe out".

A further object of the present invention resides in a boat rudder-tiller linkage design provided with connector assemblies operatively interconnected between respect rudder-tiller arms and the tiller connector bar that allows the effective length of the tiller connector bar to be easily and conveniently adjusted within reasonable limits in order that the rudders may be adjusted for controlled "toe in" or "toe out".

It is also an object of the present invention to provide a boat rudder-tiller linkage arrangement with the connector assemblies of the present invention that preserve the relative motion within the linkage network intended by the boat design.

It is also an object of the present invention to provide a boat rudder-tiller linkage control system including the connector assemblies thereof that is designed such that the same is applicable to a wide variety of existing boats, especially multi-hull catamarans and trimarans.

Still a further object of the present invention resides in the provision of a boat rudder-tiller linkage and control system as described hereinabove that can be installed on a wide variety of boats, especially catamarans and trimarans without any structure of the boat having to be changed or modified.

A further object of the present invention resides in the provision of a boat rudder-tiller linkage system that is specifically designed to be electrically insulated such that the path from the tiller connector bar and tiller handle to the water is effectively broken by the presence of the connector assemblies of the present invention.

Another object of the present invention resides in the provision of a boat rudder-tiller linkage arrangement that is self-lubricating, thereby requiring no oil or grease, etc.

Another object of the present invention resides in the provision of a boat rudder-tiller linkage system that is stable and in operation does not include reaction forces that respond to a particular orientation of the linkage system which is common in conventional systems.

Another object of the present invention resides in the provision of a boat rudder-tiller linkage system that once properly installed requires virtually no attention or maintenance, unlike prior art linkage systems which inherently loosened with usage and required frequent, if not constant, adjustment and tightening.

Finally, it is an object of the present invention to provide a rudder-tiller linkage network with said connector assemblies, as described hereinafore, which eliminate what might be referred to as "by product" forces that are typically generated with conventional systems, by providing a connector assembly that wherein all the forces associated with connecting joints are a result of the linkage system being pushed or pulled through the tiller and not forces generated by the orientation or response of the joints themselves.

Other objects and advantages of the present invention will become apparent from a study of the following description and the accompanying drawings which are merely illustrative of the present invention.

BOAT RUDDER-TILLER LINKAGE AND CONTROL SYSTEM

With further reference to the drawings, the boat rudder-tiller linkage control system is shown and illustrated therein.

Figure 1:
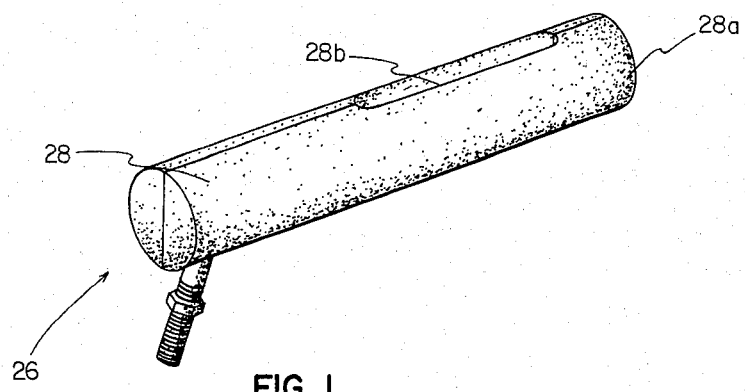
FIG. 1 is a perspective view of the connector of the present invention that is utilized to connect the rudder-tiller arm with the tiller bar connector of a boat.
Figure 2:
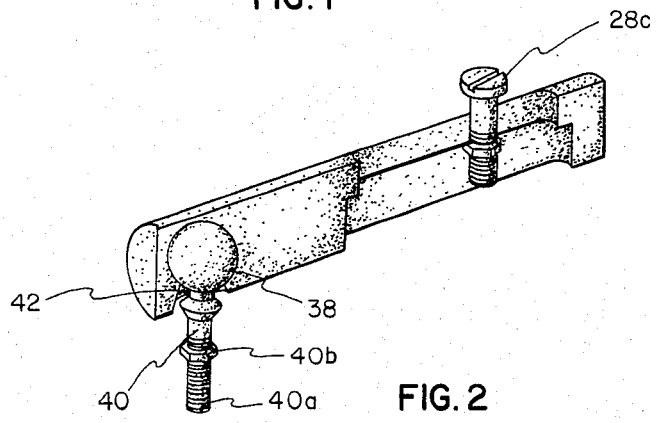
FIG. 2 is a perspective sectional view of the connector shown in FIG. 1.
Figure 3:
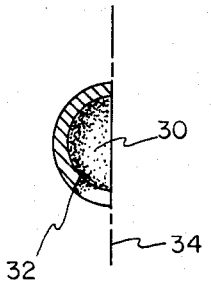
FIG. 3 is an illustration of the cavity and cutout portion thereof that forms a part of a female receiver that is adapted to receive a ball joint forming a part of the connector of the present invention.
Figure 4:
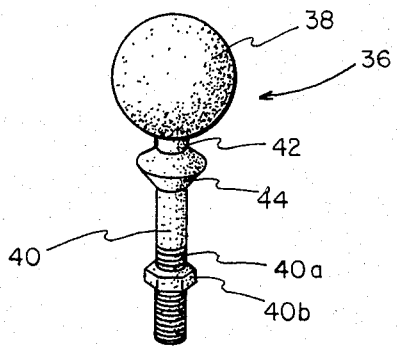
FIG. 4 is a perspective view of the ball joint assembly of the connector of the present invention.
Figure 5:
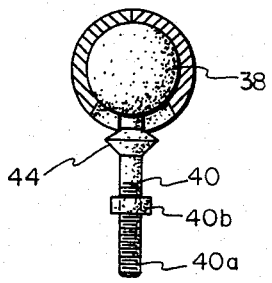
FIG. 5 illustrates the ball joint movably contained within a female receiving cavity of the connector of the present invention.
Figure 6:
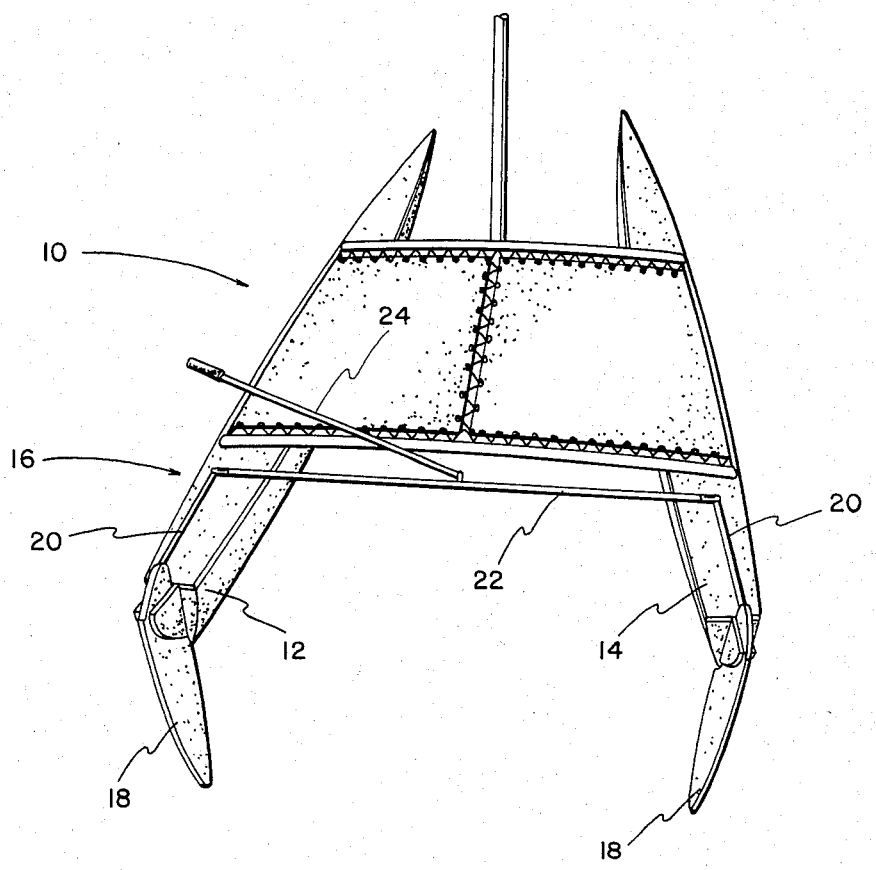
FIG. 6 is a perspective view of a catamaran having the rudder-tiller linkage arrangement of the present invention incorporated therein.

For purposes of illustration, the boat rudder-tiller linkage and control system is shown in FIG. 6 in conjunction with a boat 10. Although the present rudder-tiller linkage and control system 26 may be utilized in a wide variety of boats that utilize a rudder-tiller control, boat 10 illustrated herein is of the multi-hull or catamaran sailboat type. As illustrated in the drawings and particularly FIG. 6, boat 10 includes a pair of spaced apart hulls 12 and 14 that are typically interconnected by a frame structure including a trampoline and mast. Details of boat 10 are not dealt with herein because such is not per se material to the present invention and further because the structure and function thereof are well known and appreciated in the art.

Secured about the stern of boat 10 is the rudder-tiller linkage and control system of the present invention, and the same is generally referred to by the numeral 16.

The rudder-tiller linkage and control system 16 comprise a plurality of rudders 18, with each rudder being secured to the stern end of a respective hull 12 and 14. Secured to each rudder 18 and extending generally forwardly therefrom is a rudder-tiller arm 20. The respective rudder-tiller arms 20 are interconnected by a tiller connector bar 22. Secured to an intermediate point on said tiller connector bar 22 is a tiller handle 24 that is ordinarily manipulated by the boat's skipper in the process of navigating the boat through various waters.

Operatively interconnected between the respective rudder-tiller arms 20 and the tiller connecting bar 22 is a connector assembly, indicated generally by the numeral 26 and shown in FIGS. 1–5. Before viewing connector assembly 26 in detail, it should be remembered that each connector assembly will form a joint between the respective rudder-tiller arms 20 and the tiller connector bar 22. As discussed hereinabove, because of the various positions and orientations that the rudders, rudder-tiller arms, and tiller connector bar may assume during the course of the normal operation of boat 10, it is necessary for the connector assembly 26 to provide for a substantial degree of relative movement between the respective rudder-tiller arms 20 and the tiller connector bar 22.

Viewing a respective connector 26 in detail, it is seen that the same includes a housing structure 28. Although housing 28 could be constructed of various types of material, it is contemplated that the same should preferably be formed of nylon or plastic. As illustrated in the drawings, housing 28 assumes a generally elongated cylindrical shape in the embodiment disclosed herein. One portion of the housing is referred to as a cylindrical extension 28*a*. This portion of housing 28 includes a slot 28*b* that is adapted to receive a bolt and nut assembly 28*c*. In the boat rudder-tiller linkage and control system 16 referred to above, the cylindrical extension portion 28*a* of housing 28 is designed and adapted to be received within the hollow end of tiller connector bar 22. By providing an appropriate opening or openings within the end of tiller connector bar 22 to receive the bolt and nut assembly 28*c*, it is appreciated that the position of the housing 28 therein can be adjusted so as to effectively adjust "toe in" or "toe out" of the boat 10.

Continuing to refer to connector 26, it is seen that formed about the portion of housing 28 that extends outwardly from tiller connector bar 22, there is provided a female receiving cavity 30. Receiving cavity 30 assumes a generally hemispherical shape and is provided with a conical cutout 32. In the drawings, it is seen that conical cutout 32 when viewed in plane, as illustrated in the drawings, forms an angle of approximately 30 degrees from a central reference line 34 that extends centrally through the spherical shaped cavity 30. It is appreciated that conical cutout 32 extends symmetrically around said central reference line 34.

Rotatively secured within female receiving cavity is a male ball joint 36. Ball joint assembly 36 includes a ball joint 38 rotatively confined within spherical cavity 30. Forming an integral part of ball joint 38 is a connecting pin 40. Connecting pin 40 includes an elongated stud portion 40*a* and a threaded nut 40*b*. Disposed adjacent the underside of ball joint 38 is a shoulder 42 that includes a conical shaped seat 44 formed about the underside thereof that allows the shoulder to be easily secured while nut 40 is being tightened or removed.

As connected within rudder-tiller linkage control system 16, the forwardmost end of the respective rudder-tiller arms 20 are provided with an opening through which connecting pin 40 of ball joint assembly 36 is connected. Once nut 40*b* is appropriately tightened, it is appreciated that each respective rudder-tiller arm 20 is held between nut 40*b* and seat 44 of shoulder 42.

In operation as the tiller connector bar 22 is moved laterally back and forth, it is appreciated that the ball 38 may rotate within housing 28. The center line of connecting pin 40 is consequently stated to be a primary axis, that being the elongated axis of stud 40*a*, and it is about this primary axis that the first degree of freedom of the rudder-tiller linkage and control system is realized.

Because connecting pin 40 forms a part of ball joint assembly 36, it is appreciated that the connecting pin 40 and its primary axis may move also as ball joint 38 rotates or oscillates within female cavity 30. Consequently, additional degrees of freedom are achieved through the ball joint assembly 36.

For example, ball joint assembly 36 may oscillate laterally back and forth in a plane that extends generally perpendicular to a fore-and-aft axis of boat 10.

In addition, ball joint assembly 36 may also rotate fore-and-aftly in a plane that extends generally parallel to the fore-and-aft axis of boat 10. This movement and the need therefor is realized because of the various positions that the rudders 18, rudder-tiller arms 20 and tiller connector bar 22 can assume during the normal operation of boat 10.

Although the ball joint assembly 36 has been described as providing for movement in a lateral plane and a fore-and-aft plane, it is appreciated that in reality the ball joint assembly 36 can provide for movement in an infinite number of planes. For example, the connecting pin 40 through ball joint assembly 36 can move in a circular fashion with the exterior of shaft 40*b* engaging the conical cutout 32 formed about a portion of said spherical cavity 30.

It is appreciated from the drawings that the conical cutout 32 does limit relative movement between the rudder-tiller arms 20 and the tiller connector bar 22. Although this limitation may vary, it is contemplated that an approximate 20 degree cone of freedom around said reference line 34 would be sufficient in most cases. To provide this and some marginal space if required, it is seen in the drawings that the conical cutout 32 forms an approximately 30 degree cone around the reference line 34.

From the foregoing discussion and specification, it is appreciated that the present invention presents an improved boat rudder-tiller linkage and control system over conventional systems known. Of particular importance is the fact that the present system gives ample room for relative movement between the rudder-tiller arms and tiller connector bar in at least three planes or about three mutually perpendicular axes in order that problems or failure with such linkage and connector system are avoided. More particularly, the boat 10 can function in its designed and intended manner without experiencing unfavorable operating characteristics and without the connectors breaking or otherwise failing.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. In a multi-hull boat having a plurality of rudders secured thereto, a rudder-tiller arm associated with each rudder and extending therefrom, a tiller connector bar operatively interconnecting said rudder tiller arms, a tiller handle connecting to said tiller connector bar and extending therefrom, the improvement comprising a connector assembly for interconnecting selected rudder-tiller arms with said tiller connector bar for allowing rotation about a primary axis but which also allows said primary axis to move both laterally back and forth and fore-and-aftly, giving rise to at least three degrees of freedom of movement provided by said connector assembly between a respective rudder-tiller arm and said tiller connector bar, said connector assembly comprising:

a housing structure;

a female receiving cavity formed in said housing structure;

a male ball joint rotatively confined within said female receiving cavity;

a connecting pin secured to said male ball joint and extending therefrom wherein said connecting pin forms said primary axis along the longitudinal axis thereof;

a conical cut out formed around the portion of said cavity through which said connecting pin extends; and means for connecting said connecting pin of said connector assembly to a respective rudder-tiller arm and said housing structure of said connector assembly to said tiller connector bar wherein relative rotary movement may occur about the primary axis defined by said connecting pin while said connecting pin itself may move laterally back and forth or fore-and-aftly while the end of said tiller connector bar moves vertically through the rotation of said male ball joint within said female receiving cavity of said connector assembly.

2. The improved connector assembly of claim 1 wherein said connector assembly is operatively interconnected between said rudder-tiller arm and said tiller connector bar such that said rudder-tiller arm is secured to said connecting pin and said housing of said connector assembly is secured to said tiller connector bar wherein said rudder-tiller arm may effectively rotate about said primary axis while said connecting pin and said primary axis thereof may both move laterally back-and-forth as well as fore-and-aftly which allows said tiller connector bar to be tilted or moved laterally back and forth or fore-and-aftly with respect to said rudder-tiller arm.

3. The improved connector assembly of claim 1, wherein said cutout formed about a portion of said female's spherical cavity effectively limits the movement of said connecting pin, and wherein when said connecting pin extends centrally through said cutout said connecting pin may move at least 20 degrees to either side of said central location in at least two different planes.

4. The improved connector assembly of claim 3 wherein said housing of said connector assembly includes means for adjustably securing said housing directly to said tiller connector bar.

5. The improved connector assembly of claim 4 wherein said adjustable connecting means is provided by an extension of said housing that is adapted to be secured within an opening formed within said tiller connector bar.

6. The improved connector assembly of claim 5 wherein said connecting pin extends from said male ball joint and includes a threaded portion, and wherein there is provided a shoulder on said connecting pin adjacent said male ball joint, and wherein said rudder-tiller arm is rigidly connected to said connecting pin between said shoulder and a nut threaded onto said connecting pin.

7. A rudder tiller control system comprising:

a tiller;

a plurality of rudders and their respective rudder-tiller arms;

said rudder-tiller arms being connected to said tiller by a connector assembly;

said connector assembly comprising:

an elongate tiller connector bar;

a housing securely mounted on the end of said tiller connector bar;

a spherical receiving cavity recessed within said housing, a ball member having a spherical portion and a shaft, the spherical portion of said ball member rotatively engaging the interior wall of said cavity, the interior wall of said cavity having a conical opening through which the shaft of said ball member projects, means for securing one of said rudder-tiller arms to the shaft of said ball member, means for limiting the movement of said one rudder-tiller arm along the shaft of said ball member in a manner effective to prevent said one rudder-tiller arm from interfering with the movement of the spherical portion of said ball member in said cavity; and said ball member and the conical opening in the interior wall of said cavity cooperating with said one rudder-tiller arm in a manner effective to allow movement of said tiller horizontally, vertically and laterally while simultaneously allowing horizontal movement of said tiller to cause the pivoting of one of said rudders.

8. The rudder tiller control system of claim 7 wherein said housing is comprised of an electrically non-conductive material.

9. The rudder tiller control system of claim 7 wherein said housing is adjustably mounted on the end of said tiller connector bar to allow adjustment of the toe-in of said one rudder.

10. The rudder tiller control system of claim 7 wherein the conical opening of the interior wall of said cavity forms an angle of approximately 30 degrees relative to the straight shaft of said ball member.

* * * * *